US009384709B2

(12) United States Patent
Winer

(10) Patent No.: US 9,384,709 B2
(45) Date of Patent: Jul. 5, 2016

(54) TECHNIQUES, APPARATUS, SYSTEM AND METHOD FOR IMPROVED DISPLAY CALIBRATION

(71) Applicant: Intel Corporation, Santa Clara, CA (US)

(72) Inventor: Paul Winer, Santa Clara, CA (US)

(73) Assignee: INTEL CORPORATION, Santa Clara, CA (US)

( * ) Notice: Subject to any disclaimer, the term of this patent is extended or adjusted under 35 U.S.C. 154(b) by 421 days.

(21) Appl. No.: 13/930,268

(22) Filed: Jun. 28, 2013

(65) Prior Publication Data

US 2015/0002496 A1 Jan. 1, 2015

(51) Int. Cl.
*G09G 5/02* (2006.01)
*G09G 3/00* (2006.01)

(52) U.S. Cl.
CPC ..... *G09G 5/026* (2013.01); *G09G 3/006* (2013.01); *G09G 2320/0242* (2013.01); *G09G 2320/0693* (2013.01); *G09G 2330/12* (2013.01)

(58) Field of Classification Search
None
See application file for complete search history.

(56) References Cited

U.S. PATENT DOCUMENTS

| | | | | |
|---|---|---|---|---|
| 8,379,060 | B2 * | 2/2013 | Kwong | G09G 5/00 345/102 |
| 8,836,796 | B2 * | 9/2014 | Dickins | G09G 3/006 348/189 |
| 2009/0009752 | A1 * | 1/2009 | Duggan | G01D 18/004 356/218 |
| 2009/0141022 | A1 * | 6/2009 | Kimpe | H04N 9/07 345/419 |
| 2014/0176444 | A1 * | 6/2014 | Sultenfuss | G09G 5/02 345/168 |

* cited by examiner

*Primary Examiner* — Ryan R Yang

(57) ABSTRACT

Embodiments of a device, system, method and other techniques are described for improved display calibration. An apparatus for display calibration may comprise, for example an optical waveguide comprising an entrance portion and an exit portion at different locations on a base portion of the apparatus, the optical waveguide to guide light output from a display of the apparatus arranged in a lid portion of the apparatus to a camera arranged in the lid portion of the apparatus and calibration logic at least a portion of which is in hardware, the calibration logic to measure one or more color attributes of the light output from the display and to calibrate one or more parameters of the display based on the measured color attributes. Other embodiments are described.

22 Claims, 10 Drawing Sheets

200

TECHNIQUES, APPARATUS, SYSTEM AND METHOD FOR IMPROVED DISPLAY CALIBRATION

TECHNICAL FIELD

Embodiments described herein generally relate to techniques, apparatus, systems and methods for improved display calibration.

BACKGROUND

Modern computing systems typically include a display or monitor to display text and/or images processed by or stored in the computing system. The display may be able to display color visual elements such as colored images, photographs, video broadcasts, windows, graphic user interface elements, or the like. Many modern displays are capable of rendering high-resolution graphics and images. Unfortunately, the colors displayed on the display may change during the operation of the computing system. For example, the colors displayed on the display may change over time as one or more components of the display change (e.g. age) and, as a result, the text and/or images may not be rendered as expected. For example, the display may display visual elements having incorrect colors (e.g., pink instead of red for example) diminishing the usefulness and user experience for the computing system. Consequently, a need exists for improved display calibration techniques.

DETAILED DESCRIPTION

The embodiments are generally directed to techniques designed to improve display calibration using an integrated optical waveguide. Various embodiments provide techniques that include an optical waveguide comprising an entrance portion and an exit portion arranged at different locations on a base portion of an apparatus such as a laptop or notebook computer. In various embodiments, the optical waveguide may be arranged to guide light output from a display of the apparatus to a camera of the apparatus. The apparatus may include calibration logic at least a portion of which is in hardware in some embodiments, wherein the calibration logic is operative to measure one or more color attributes of the light output from the display and to calibrate one or more parameters of the display based on the measured color attributes. Other embodiments are described and claimed.

It may be necessary over the course of time to calibrate a display of a computing system. In the past, an external device, such as an external calibration camera, was arranged to capture visual information displayed by the display and this information was used to generate data that could be used by a user or by the computing system to calibrate the display. These approaches require costly hardware that is often difficult to use and, if not set up correctly, produces inaccurate calibration data. Other solutions often rely on sensors that are capable of capturing visual information displayed by the display. These sensors are often incorporated into the computing system, but as with the above solutions these sensor solutions require the addition of costly hardware to computing systems that increase manufacturing costs and occupy valuable space in computing systems that are decreasing in size over time. It is with respect to these and other considerations that the embodiments described herein are needed.

Embodiments may include one or more elements. An element may comprise any structure arranged to perform certain operations. Each element may be implemented as hardware, software, or any combination thereof, as desired for a given set of design parameters or performance constraints. Although embodiments may be described with particular elements in certain arrangements by way of example, embodiments may include other combinations of elements in alternate arrangements.

It is worthy to note that any reference to "one embodiment" or "an embodiment" means that a particular feature, structure, or characteristic described in connection with the embodiment is included in at least one embodiment. The appearances of the phrases "in one embodiment" and "in an embodiment" in various places in the specification are not necessarily all referring to the same embodiment. The same is true for the phrases "some embodiments" and "various embodiments."

Figure 1:
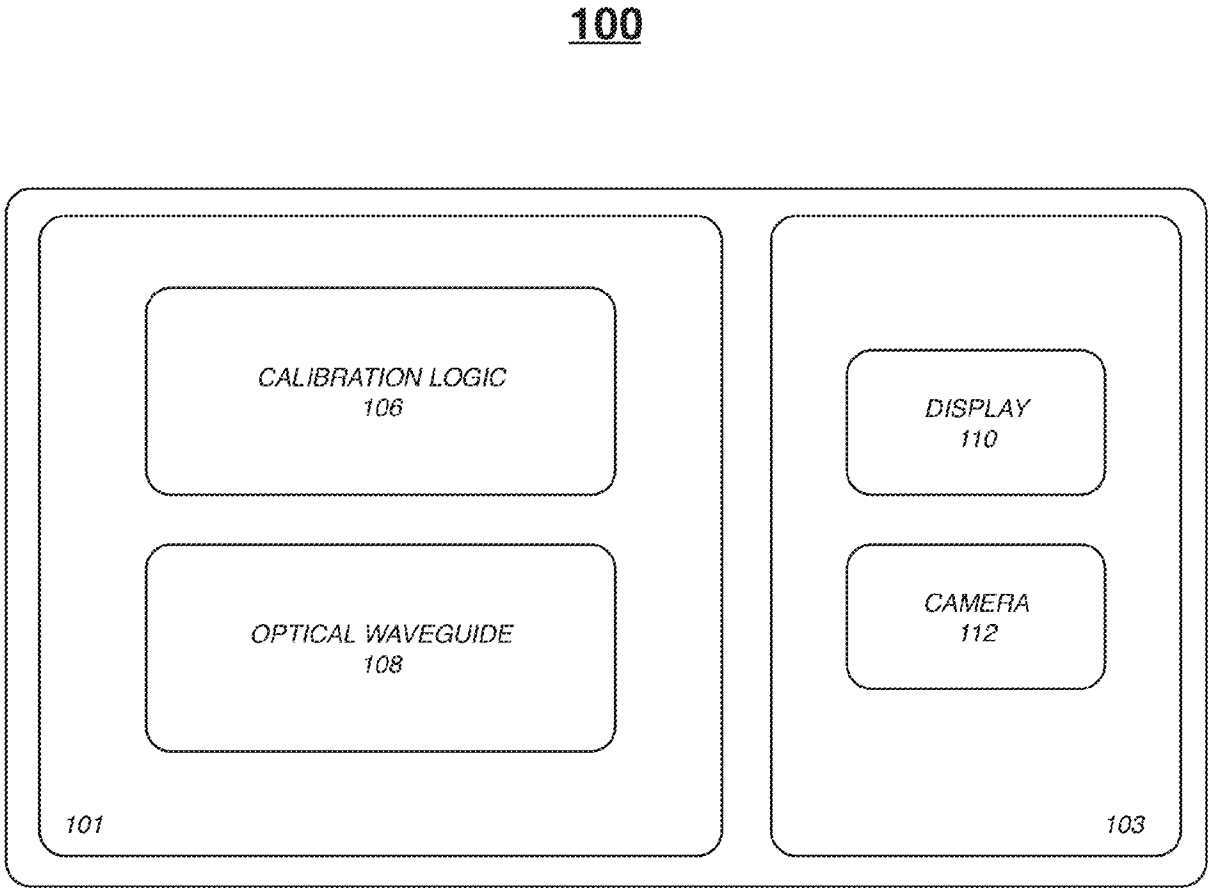
FIG. 1 illustrates one embodiments of an apparatus.

FIG. 1 illustrates one embodiment of an apparatus 100. The apparatus 100 may comprise a computing system in some embodiments. As described herein, a computing system may include but is not limited to a laptop computer, notebook computer, netbook computer, Ultrabook™ device, clamshell computer, hybrid tablet and input/output (I/O) computer, a smartphone, a cellular phone, a personal digital assistance (PDA) or any other suitable computing device or system as one skilled in the art will readily understand.

In various embodiments, the computing systems described herein may be described for purposes of illustration and not limitation with reference to a base portion and a lid portion that may be mechanically coupled (e.g. via a hinge or the like) to allow the portions to rotate with respect to one another. The mechanical coupling of the lid portion and the base portion may form a complete computing system as illustrated herein in some embodiments. It should be understood that the embodiments are not limited to the form factors described herein and that a limited number, type and arrangement of form factors, devices and system are presented for purposes of illustration and not limitation.

The term lid portion as used herein may include, for example, the physical portion of a computing system or a laptop computer having or containing the display or display unit of the computing system, or a portion or a "half" of the computing system or laptop computer having or containing the display or display unit. The term base portion as used herein may include, for example, the physical portion of a computing system or a laptop computer having or containing one or more I/O devices such as a keyboard and/or a track pad and arranged to support or enclose one or more platform components such as a processor and/or memory. Each of the lid portion and the base portion may comprise an enclosure or casing portion of the computing system. Other embodiments are described and claimed.

As shown in FIG. 1, the computing system 100 may comprise a plurality of components including but not limited to calibration logic 106, optical waveguide 108, display 110 and camera 112. In other embodiments (not shown), FIG. 1 may additionally/alternatively include a processor and/or memory. FIG. 1 additionally illustrates the separation of these components in a base portion 101 and a lid portion 103 of the computing device 100. While shown in separate portions in FIG. 1, it should be understood that the embodiments are not limited in this respect and any of the components could be arranged in either portion 101 or 103 or in a portion of the computing system 100 not shown in FIG. 1 and still fall within the described embodiments.

In various embodiments, computing system 100 may comprise a processor 102. The processor 102 can be any of various commercially available processors, including without limitation an AMD® Athlon®, Duron® and Opteron® processors; ARM® application, embedded and secure processors; IBM® and Motorola® DragonBall® and PowerPC® processors; IBM and Sony® Cell processors; Intel® Celeron®, Core™ (2) Duo, Core™ (2) Quad, Core i3™, Core i5™, Core i7™, Atom™, Itanium®, Pentium®, Xeon®, and XScale® processors; and similar processors. Dual microprocessors, multicore processors, and other multi-processor architectures may also be employed as the processing 102.

In various embodiments, computing system 100 may comprise a memory or memory unit 104. The memory 104 may store, among other types of information, calibration logic 106. The memory 104 may include various types of computer-readable storage media (including but not limited to non-transitory computer-readable media) in the form of one or more higher speed memory units, such as read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory, polymer memory such as ferroelectric polymer memory, ovonic memory, phase change or ferroelectric memory, silicon-oxide-nitride-oxide-silicon (SONOS) memory, magnetic or optical cards, an array of devices such as Redundant Array of Independent Disks (RAID) drives, solid state memory devices (e.g., USB memory, solid state drives (SSD) and any other type of storage media suitable for storing information.

In various embodiments, the computing system 100 may comprise one or more input/output devices. The one or more input/output devices may be arranged to provide functionality to the computing system 100 including but not limited to capturing images, exchanging information, capturing or reproducing multimedia information, determining a location of the computing system 100 or any other suitable functionality. Non-limiting examples of input/output devices include a camera 112, QR reader/writer, bar code reader, a global positioning system (GPS) module, and a display 110 coupled to or integrated within computing system 100. The embodiments are not limited in this respect.

The computing system 100 may comprise one or more displays 110 in some embodiments. The displays 110 may comprise any digital display device suitable for the computing system 100. For instance, the displays 110 may be implemented by a liquid crystal display (LCD) such as a touch-sensitive, color, thin-film transistor (TFT) LCD, a plasma display, a light emitting diode (LED) display, an organic light emitting diode (OLED) display, a cathode ray tube (CRT) display, or other type of suitable visual interface for displaying content to a user of the computing system 100. The displays 110 may further include some form of a backlight or brightness emitter as desired for a given implementation.

In various embodiments, the displays 110 may comprise touch-sensitive or touchscreen displays. A touchscreen may comprise an electronic visual display that is operative to detect the presence and location of a touch within the display area or touch interface. In some embodiments, the display may be sensitive or responsive to touching of the display of the device with a finger or hand. In other embodiments, the display may be operative to sense other passive objects, such as a stylus or electronic pen. In various embodiments, displays 110 may enable a user to interact directly with what is displayed, rather than indirectly with a pointer controlled by a mouse or touchpad. Other embodiments are described and claimed.

Computing system 100 may include one or more cameras 112 in some embodiments. In various embodiments, camera 112 may comprise any suitable optical instrument that is capable of recording or capturing images that can be stored directly on the computing system 100, transmitted to another location, or both. These images captured by camera 112 may comprise still photographs or moving images such as videos or movies. In various embodiments, the camera 112 described herein may comprise a bezel-mounted camera that is integrated into the lid portion 103 of the computing system 100. For example, the camera 112 be integrated into a bezel of the lid portion 103 in an area of the lid portion 103 above the display 112 as shown and described elsewhere herein. The embodiments are not limited in this respect.

While not shown, computing system 100 may comprise one or more wireless transceivers. Each of the wireless transceivers may be implemented as physical wireless adapters or virtual wireless adapters sometimes referred to as "hardware radios" and "software radios." In the latter case, a single physical wireless adapter may be virtualized using software into multiple virtual wireless adapters. A physical wireless adapter typically connects to a hardware-based wireless access point. A virtual wireless adapter typically connects to a software-based wireless access point, sometimes referred to as a "SoftAP." For instance, a virtual wireless adapter may allow ad hoc communications between peer devices, such as a smart phone and a desktop computer or notebook computer. Various embodiments may use a single physical wireless adapter implemented as multiple virtual wireless adapters, multiple physical wireless adapters, multiple physical wireless adapters each implemented as multiple virtual wireless adapters, or some combination thereof. The embodiments are not limited in this case.

The wireless transceivers may comprise or implement various communication techniques to allow the computing system 100 to communicate with other electronic devices. For instance, the wireless transceivers may implement various types of standard communication elements designed to be interoperable with a network, such as one or more communications interfaces, network interfaces, network interface cards (NIC), radios, wireless transmitters/receivers (transceivers), wired and/or wireless communication media, physical connectors, and so forth. By way of example, and not limitation, communication media includes wired communications media and wireless communications media. Examples of wired communications media may include a wire, cable, metal leads, printed circuit boards (PCB), backplanes, switch fabrics, semiconductor material, twisted-pair wire, co-axial cable, fiber optics, a propagated signal, and so forth. Examples of wireless communications media may include acoustic, radio-frequency (RF) spectrum, infrared and other wireless media.

In various embodiments, the computing system 100 may implement different types of wireless transceivers. Each of the wireless transceivers may implement or utilize a same or different set of communication parameters to communicate information between various electronic devices. In one embodiment, for example, each of the wireless transceivers may implement or utilize a different set of communication parameters to communicate information between computing system 100 and a remote device. Some examples of communication parameters may include without limitation a communication protocol, a communication standard, a radio-frequency (RF) band, a radio, a transmitter/receiver (transceiver), a radio processor, a baseband processor, a network scanning threshold parameter, a radio-frequency channel parameter, an access point parameter, a rate selection parameter, a frame size parameter, an aggregation size parameter, a packet retry limit parameter, a protocol parameter, a radio parameter, modulation and coding scheme (MCS), acknowledgement parameter, media access control (MAC) layer parameter, physical (PHY) layer parameter, and any other communication parameters affecting operations for the wireless transceivers. The embodiments are not limited in this context.

In various embodiments, the wireless transceivers may implement different communication parameters offering varying bandwidths, communications speeds, or transmission range. For instance, a first wireless transceiver may comprise a short-range interface implementing suitable communication parameters for shorter range communications of information, while a second wireless transceiver may comprise a long-range interface implementing suitable communication parameters for longer range communications of information.

In various embodiments, the terms "short-range" and "long-range" may be relative terms referring to associated communications ranges (or distances) for associated wireless transceivers as compared to each other rather than an objective standard. In one embodiment, for example, the term "short-range" may refer to a communications range or distance for the first wireless transceiver that is shorter than a communications range or distance for another wireless transceiver implemented for the computing system 100, such as a second wireless transceiver. Similarly, the term "long-range" may refer to a communications range or distance for the second wireless transceiver that is longer than a communications range or distance for another wireless transceiver implemented for the computing system 100, such as the first wireless transceiver. The embodiments are not limited in this context.

In various embodiments, the terms "short-range" and "long-range" may be relative terms referring to associated communications ranges (or distances) for associated wireless transceivers as compared to an objective measure, such as provided by a communications standard, protocol or interface. In one embodiment, for example, the term "short-range" may refer to a communications range or distance for the first wireless transceiver that is shorter than 300 meters or some other defined distance. Similarly, the term "long-range" may refer to a communications range or distance for the second wireless transceiver that is longer than 300 meters or some other defined distance. The embodiments are not limited in this context.

In one embodiment, for example, the wireless transceiver may comprise a radio designed to communicate information over a wireless personal area network (WPAN) or a wireless local area network (WLAN). The wireless transceiver may be arranged to provide data communications functionality in accordance with different types of lower range wireless network systems or protocols. Examples of suitable WPAN systems offering lower range data communication services may include a Bluetooth system as defined by the Bluetooth Special Interest Group, an infra-red (IR) system, an Institute of Electrical and Electronics Engineers (IEEE) 802.15 system, a DASH7 system, wireless universal serial bus (USB), wireless high-definition (HD), an ultra-side band (UWB) system, and similar systems. Examples of suitable WLAN systems offering lower range data communications services may include the IEEE 802.xx series of protocols, such as the IEEE 802.11a/b/g/n series of standard protocols and variants (also referred to as "WiFi"). It may be appreciated that other wireless techniques may be implemented, and the embodiments are not limited in this context.

In one embodiment, for example, the wireless transceiver may comprise a radio designed to communicate information over a wireless local area network (WLAN), a wireless metropolitan area network (WMAN), a wireless wide area network (WWAN), or a cellular radiotelephone system. The wireless transceiver may be arranged to provide data communications functionality in accordance with different types of longer range wireless network systems or protocols. Examples of suitable wireless network systems offering longer range data communication services may include the IEEE 802.xx series of protocols, such as the IEEE 802.11a/b/g/n series of standard protocols and variants, the IEEE 802.16 series of standard protocols and variants, the IEEE 802.20 series of standard protocols and variants (also referred to as "Mobile Broadband Wireless Access"), and so forth. Alternatively, the wireless transceiver may comprise a radio designed to communication information across data networking links provided by one or more cellular radiotelephone systems. Examples of cellular radiotelephone systems offering data communications services may include GSM with General Packet Radio Service (GPRS) systems (GSM/GPRS), CDMA/1×RTT systems, Enhanced Data Rates for Global Evolution (EDGE) systems, Evolution Data Only or Evolution Data Optimized (EV-DO) systems, Evolution For Data and Voice (EV-DV) systems, High Speed Downlink Packet Access (HSDPA) systems, High Speed Uplink Packet Access (HSUPA), and similar systems. It may be appreciated that other wireless techniques may be implemented, and the embodiments are not limited in this context.

Although not shown, the computing system 100 may further comprise one or more device resources commonly implemented for electronic devices, such as various computing and communications platform hardware and software components typically implemented by a personal electronic device. Some examples of device resources may include without limitation a co-processor, a graphics processing unit (GPU), a chipset/platform control hub (PCH), an input/output (I/O) device, computer-readable media, display electronics, display backlight, network interfaces, location devices (e.g., a GPS receiver), sensors (e.g., biometric, thermal, environmental, proximity, accelerometers, barometric, pressure, etc.), portable power supplies (e.g., a battery), application programs, system programs, and so forth. Other examples of device resources are described with reference to exemplary computing architectures shown by FIG. 6. The embodiments, however, are not limited to these examples.

The computing system 100 may include calibration logic 106 in some embodiments. Calibration logic 106 may comprise logic, at least a portion of which is in hardware, or any other suitable module, firmware, driver, application, operation system (OS), OS extension or other software, hardware or combination of software and hardware as will be understood by one skilled in the art. In various embodiments, functionality of the calibration logic 106, including but not limited to performing calibration functions related to display 110, is described in more detail elsewhere herein.

In various embodiments, computing system 100 may include an optical waveguide 108. Optical waveguide 108 may comprise any suitable structure that guides waves, such as light waves, electromagnetic waves or sound waves from an entrance of the waveguide to an exit of the waveguide. For example, in some embodiments optical waveguide 108 may comprise a tube or pipe arranged to transport, guide, transfer or other move light from one location to another location, minimizing the loss of light based on the internal reflective characteristics of the optical waveguide 108. In various embodiments, the optical waveguide 108 may comprise at least one entrance portion, an exit portion and a portion of reflective conduit to couple the entrance portion and the exit portion. As used herein, the term entrance/exit portion may comprise or be interchangeable with the term aperture and/or lens that may refer to a hole or an opening through which light travels and the term conduit refers to a channel or other suitable structure for conveying light or other waves. The embodiments are not limited in this respect.

While described herein as an optical waveguide 108, it should be understood that other names could be used interchangeably with the term optical waveguide and still fall within the described embodiments including but not limited to light pipe, optical connection, optical coupling and the like. As will be understood with reference to the following figures and description, in some embodiments the optical waveguide 108 may comprise or include an entrance portion and an exit portion at different locations on a base portion 102 of the computing system 100, wherein the optical waveguide 108 is arranged or operative to guide light output from display 110 of to camera 112. Other embodiments are described and claimed.

Figure 2A:
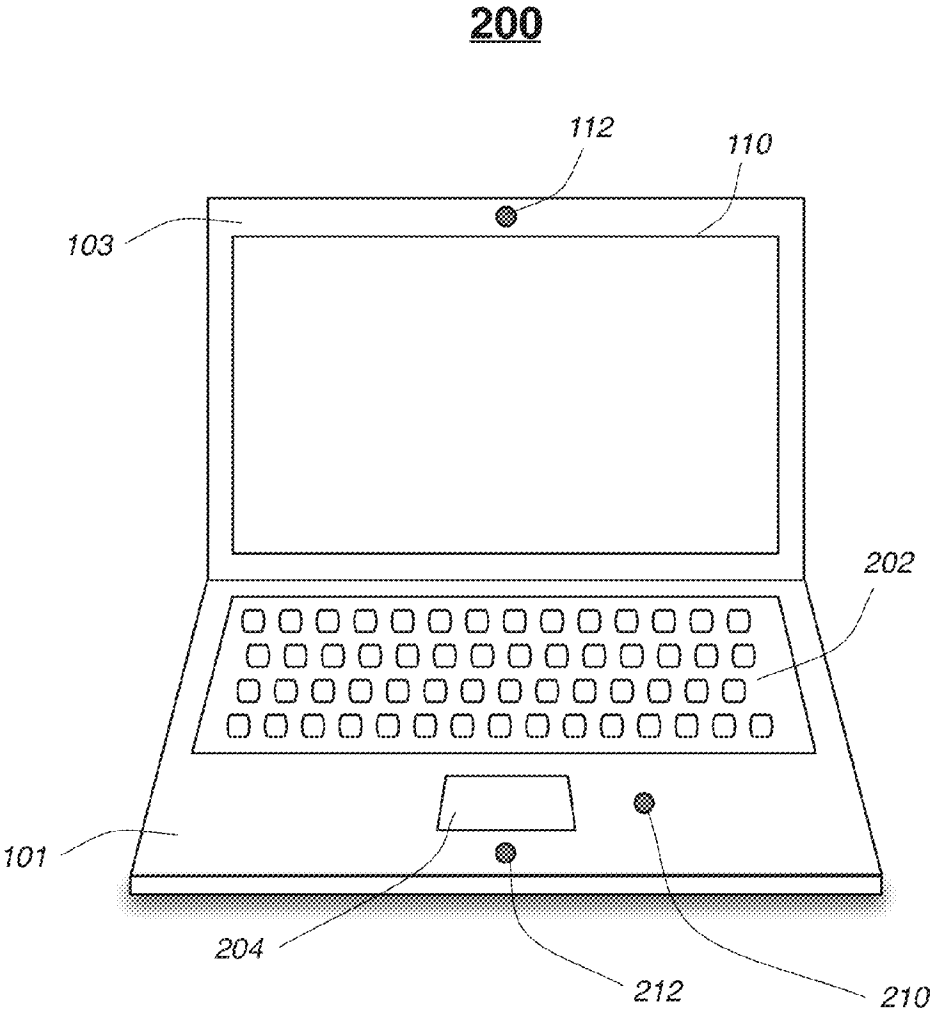
FIGS. 2A-2C illustrate embodiments a computing system.
Figure 2B:
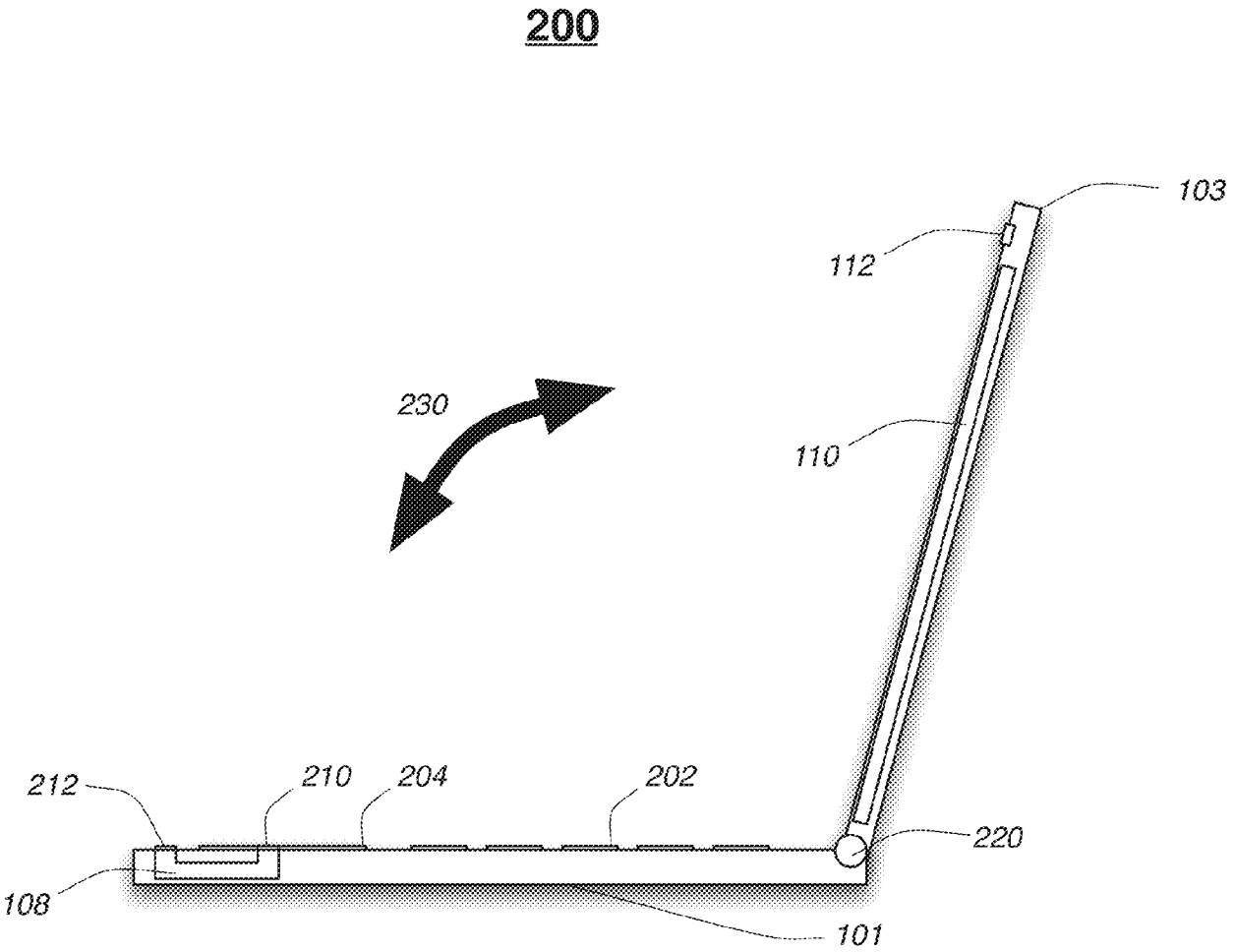
Figure 2C:
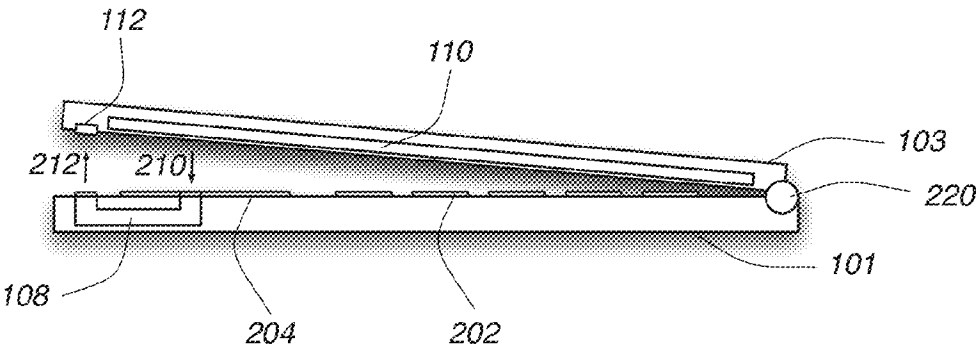

FIGS. 2A-2C illustration embodiments and different perspective views of a computing system 200 that may be the same or similar to computing system 100 of FIG. 1 where like elements are similarly numbered. In various embodiments, computing system 200 may comprise a computing device such as a laptop or notebook computer. As shown in FIG. 2A, computing system 200 may include a base portion 101, lid portion 103, display 110, camera 112, keyboard 202, track pad 204, entrance portion 210 and exit portion 212. The embodiments are not limited to the number, type or arrangement of components shown in FIG. 2A that are presented for purposes of illustration and not limitation.

As shown in FIG. 2A which may comprise a front perspective view of a computing system 200, the display 110 and camera 112 may be arranged as part of lid portion 103 while the entrance portion 210 and exit portion 212 (corresponding to the entrance and exit of optical waveguide 108 that is not shown in FIG. 2A) are arranged as part of base portion 101. As will be understood with reference to the following figures and description, the entrance portion 210 may be arranged to align with a portion of the display 110 when the lid portion 103 is in a closed position and the exit portion 212 may be arranged to align with the camera 112 when the lid portion 101 is in the closed position. Other embodiments are described and claimed.

FIG. 2B illustrates a side perspective view of the computing system 200. The optical waveguide 108 is visible in FIG. 2B showing the connection or optical coupling of the entrance portion 210 to the exit portion 212. As described above and as shown in FIGS. 2A and 2B, the entrance portion 210 and the exit portion 212 are arranged at different locations on the base portion 101 of the computing system 200. For example, the entrance portion 210 may be arranged to align with a portion of the display 110 when the lid portion 103 is in a closed position and the exit portion 212 may be arranged to align with the camera 112 when the lid portion 103 is in the closed position.

In various embodiments, the optical waveguide 108 may be arranged inside the base portion 101 of the computing system and the entrance portion 210 and exit portion 212 may be arranged substantially flush with a top surface (e.g. the surface including the keyboard 202 and track pad 204) of the base portion 101 of the computing system, facing and substantially parallel with the display 110 when the lid portion 103 is in a closed position. In some embodiments, the entrance portion 210 and exit portion 212 may be arranged to have minimal impact on the aesthetic appearance of the computing system 200. Additionally, while not shown in the figures, in some embodiments a plurality of entrance portions 210 may be arranged at different locations on a top surface of the base portion 101 of the computing system 200 which may all direct or conduct light to the exit portion 212, allowing for the receipt of light from multiple/different portions of the display 110. The embodiments are not limited in this respect.

Figure 3A:
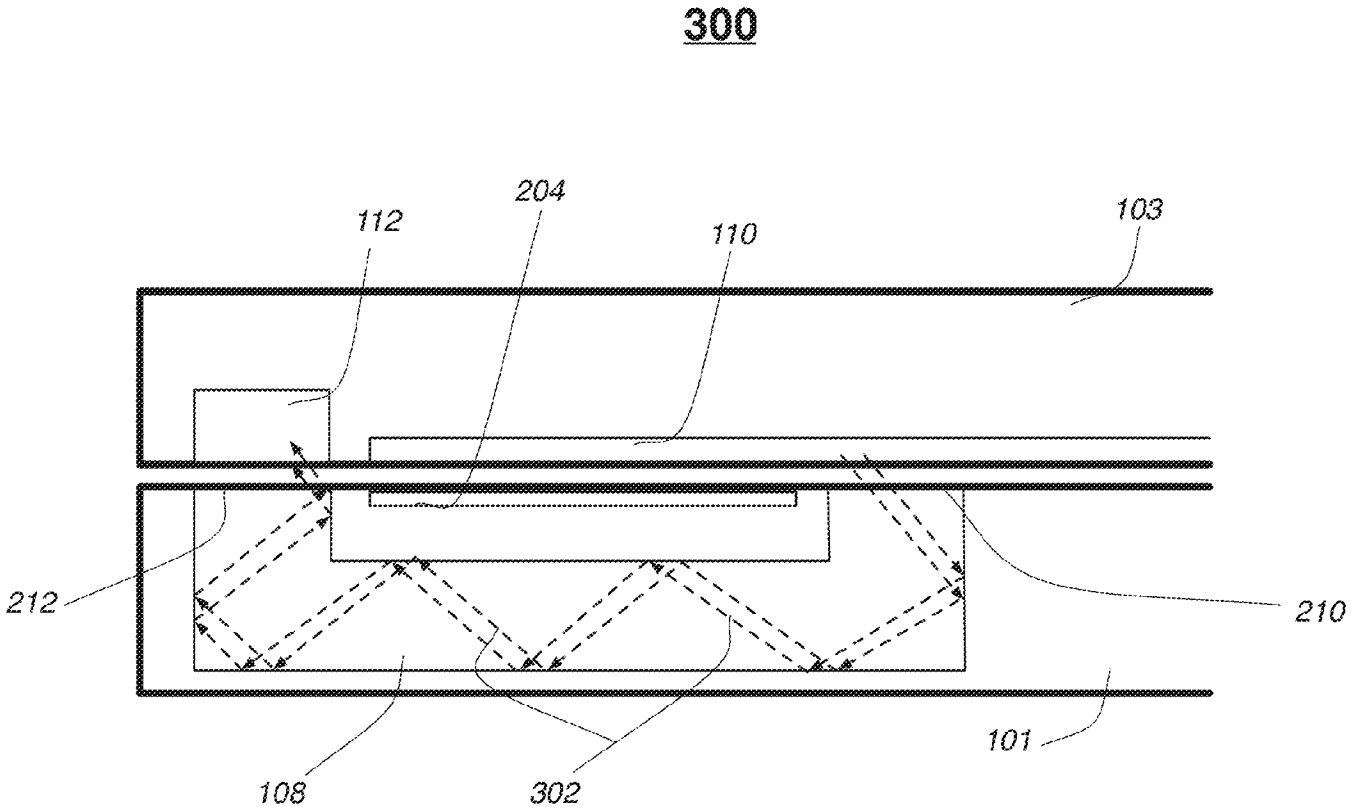
FIG. 3A-3C illustrate embodiments of an optical waveguide.
Figure 3B:
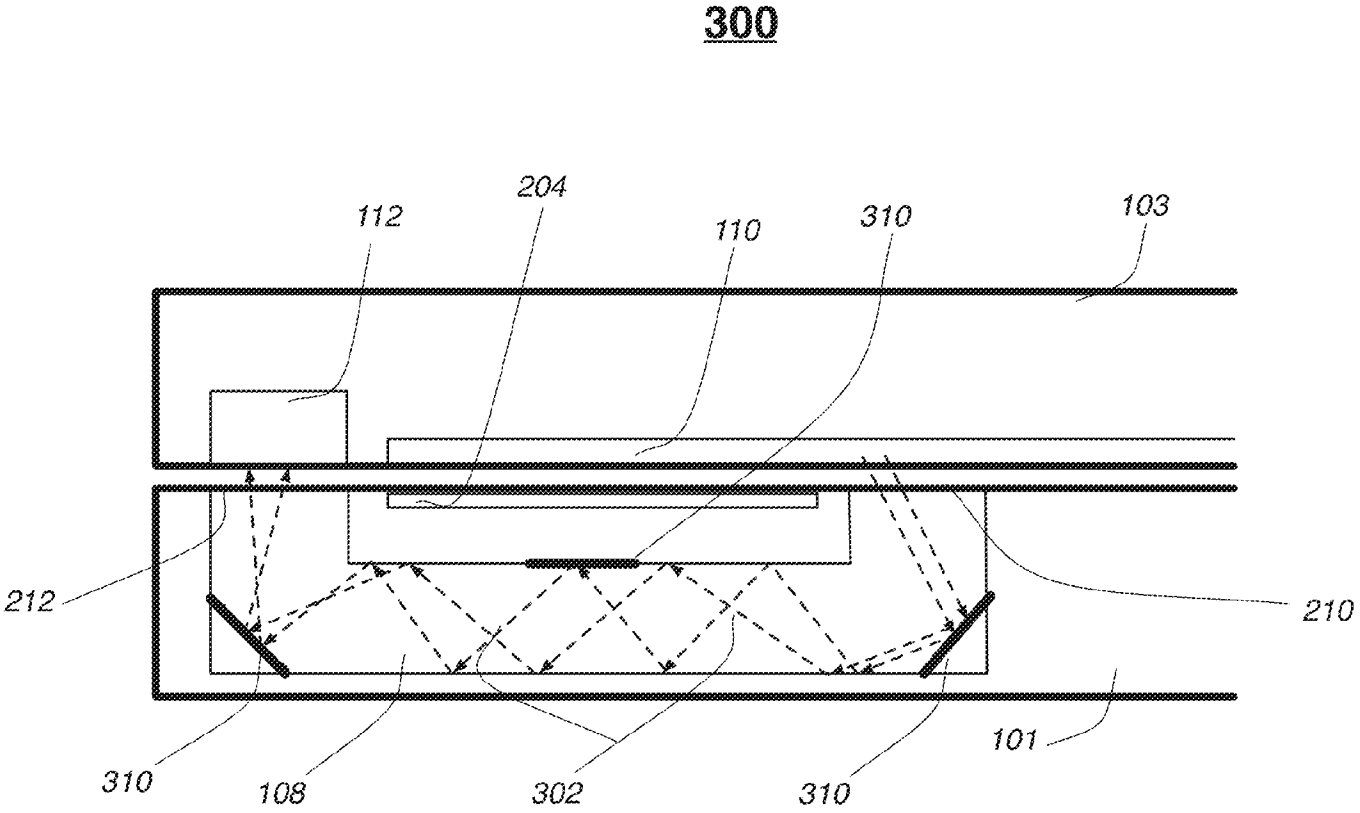
Figure 3C:
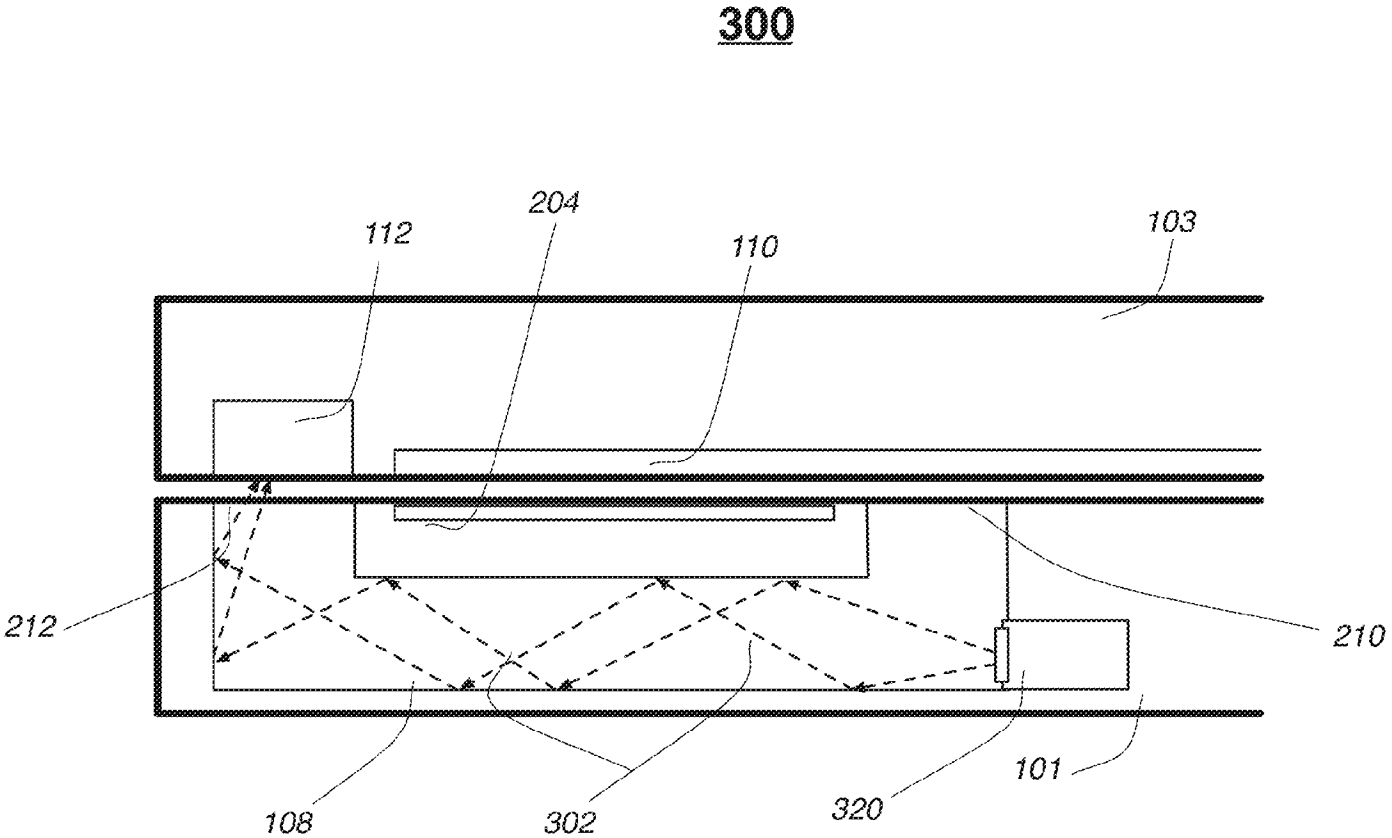

The computing system 200 shown in FIG. 2B is arranged in an open position wherein the display 110 and the I/O devices (e.g. keyboard 202 and track pad 204) may be accessible to a user. As indicated by arrow 230, the lid portion 103 may be operative to rotate arranged mechanical coupling 220 (e.g. a hinge or the like) to change from the open position shown in FIG. 2A to a closed position as shown in FIGS. 3A-3C. In the partially closed position shown in FIG. 2C, it can be seen that light from the display may be allowed to enter the entrance portion indicated by the arrow at 210 and the light may be conducted through the optical waveguide 108 and allowed to exit the exit portion 212 to be captured by camera 112 as illustrated by the arrow at 212. Stated differently, FIG. 3C illustrates that the optical waveguide 108 may be operative to guide light output from display 110 of the computing system 200 arranged in a lid portion 103 of the computing system 200 to a camera 112 that is also arranged in the lid portion 203 of the computing system 200.

FIGS. 3A-3C illustration embodiments and close up/cutaway perspective views of a computing system 300 that may be the same or similar to computing system 100 of FIG. 1 and/or computing system 200 of FIGS. 2A-2C where like elements are similarly numbered. In various embodiments, computing system 300 may comprise a computing device such as a laptop or notebook computer arranged in a closed position where the lid portion 103 is arranged to align with or substantially align with the base portion 101. The embodiments are not limited in this respect.

As shown in FIG. 3A, the entrance portion 210 may be arranged to receive light output 302 from the display 110 and may transmit or transfer this light output 302 to the exit portion 212 which may be aligned with the camera 112 to allow the camera to capture or detect the light output 302. In various embodiments, the light output 302 may be conveyed to through the optical waveguide 108 based on the internal reflective capabilities (e.g. total or substantially total internal reflection) of the optical waveguide 108 as illustrated by the bouncing or reflection of the dashed lines representing the light output 302 and indicating one possible path for the light output 302. One skilled in the art will understand that the embodiments are not limited in this respect and the light output 302 may be received in any magnitude, direction, angle, brightness, etc. and transferred differently based on different internal properties of the optical waveguide 108. As such, the embodiments are not limited in this respect.

FIG. 3B illustrates an embodiment of the computing system 300 in which one or more mirrors or other suitable reflective surfaces 310 are arranged inside the optical waveguide 108. While shown in FIG. 3B as being arranged inside the optical waveguide 108 for purposes of illustration, it should be understood that in various embodiments the one or more mirrors 310 may be arranged on the exterior of the optical waveguide 108 which may comprise a solid light pipe in some examples. In various embodiments, the one or more mirrors 310 may be arranged inside the internally reflective conduit portion of the optical waveguide 108 to assist with the transmission of the light output 302 from the entrance portion 210 to the exit portion 212. In various embodiments, the one or more mirrors 310 may be particularly helpful when the optical waveguide 108 is arranged with angles, curves, bends or other shapes that increase the difficult of conveying the light output 302 from the entrance portion 210 to the exit portion 212. For example, while not shown, in some embodiments the optical waveguide 108 may be arranged in any number of shapes and sizes to work around other internal components of the computing system 300. In this manner, current designs may not require complete redesigns to accommodate the optical waveguide 108. Other embodiments are described and claimed.

FIG. 3C illustrates an embodiment of the computing system 300 in which a light source 320 is arranged inside a portion of the optical waveguide 108. For example, the light source 320 may comprise one or more of a red, green or blue light emitting diode (LED). In various embodiments, the light source 320 may be selected to comprise a source that sets standard light values for calibration of camera 112 as discussed in more detail below.

As described herein, transmission of light output 302 from display 110 to camera 112 via the optical waveguide 108 may provide for a simple, cost effective, efficient and easy to implement solution for display calibration. Returning to FIG. 1, in various embodiments, display calibration, camera calibration and other associated functions may be implemented and/or controlled by calibration logic 106. While various features and functionality are shown and described herein as being implemented and/or controlled by calibration logic 106 for purposes of illustration and clarity, it should be understood that other logic, modules, software, hardware or combination of software and hardware could be used and still fall within the described embodiments.

In various embodiments, the calibration logic 106, at least a portion of which is in hardware, may be operative to receive light output information and/or color/image information from camera 112 based on the light output 302 and/or color/image information captured by camera 112 as the light output 302 exits exit portion 212. In some embodiments, calibration logic 106 may be operative to measure one or more color attributes (or other suitable attributes useful for display calibration) of the light output 302 from the display 110 and captured by camera 112. For example, the light attributes may include but are not limited to position, orientation, hue, color, brightness, intensity, cone or beam angle, attenuation, decay, fall-off, etc.

The calibration logic 106 may be operative to calibrate one or more parameters of the display 110 based on the measured color attributes in some embodiments. The color attributes, light output 302 or other information may be stored, for example in memory 104, and may be processed using the calibration logic 106. Calibration logic 106 may retrieve or receive the information and may perform a calibration process, for example, using processor 102. In some embodiments, after the calibration process is complete, images and other graphical information that is output to display 110 of computing device 100 may be corrected such that the images seen in the calibrated display 110 generally correspond to the image seen in physical output devices, for example: photographs, magazine papers, HDTV broadcasts, or the like. Stated differently, the calibration process may result in the colors, brightness and other attributes of graphical information being rendered as expected and as intended.

As one skilled in the art will understand, system level actions may be necessary to place the computing system 100 in a calibration mode to enable the display 110 and camera 112 to remain active when the lid portion 103 is in the closed position. For example, the calibration logic 106 may be operative to override a pre-programmed function associated with closure of the lid portion 103 and to maintain operation of the display 110 and the camera 112 upon closure of the lid portion 103. The calibration logic 106 may additionally be operative to present a visual element on the display 110 upon closure of the lid portion 103 at least in an area of the entrance portion 210. The visual element may comprise, for example, a dynamically changing plurality of colors or color combinations that are useful for display calibration (e.g. at least red, green and blue colors).

The calibration mode may be entered or initiated in a plurality of different ways. For example, the calibration mode may be automatically initiated for a pre-defined amount of time for each closure of the lid portion 103 or it may be initiated after a pre-defined number of lid 103 closures (e.g. every tenth time the lid is closed, for example). In other embodiments, the calibration mode may be initiated manually by a dedicated calibration button press by a user or by selection of a system attribute (e.g. in a control panel or the like). Other embodiments are described and claimed.

In some embodiments, the calibration logic 106 may be operative to calibrate the camera 112 in addition to calibrating the display 110. For example, the calibration logic 106 may be operative to measure one or more color attributes of light output from the light source 320 and to calibrate one or more parameters of the camera 112 based on the measured color attributes. This camera calibration process may be performed in place of the display calibration process to avoid interference from the competing light sources. In some embodiments, the camera calibration process may be performed prior to each initiation of the display calibration process to ensure that the camera is properly calibrated prior to calibrating the display 110. In this manner, by maintaining proper camera calibration using a dedicated light source 320 separate from the display, proper display calibration using camera 112 may be maintained over time. The embodiments are not limited in this respect.

The display calibration process and/or camera calibration process may proceed, be carried out or be executed using traditional methods, as one skilled in the art will readily understand, based on one or more display 110 characteristics being captured by camera 112 by way of the optical waveguide 108 as described herein. As such, the embodiments described herein are not limited in this respect.

Included herein is a logic flow representative of example methodologies for performing one or more novel aspects of the disclosed embodiments. While, for purposes of simplicity of explanation, the one or more methodologies shown herein are shown and described as a series of acts, those skilled in the art will understand and appreciate that the methodologies are not limited by the order of acts. Some acts may, in accordance therewith, occur in a different order and/or concurrently with other acts from that shown and described herein. For example, those skilled in the art will understand and appreciate that a methodology could alternatively be represented as a series of interrelated states or events, such as in a state diagram. Moreover, not all acts illustrated in a methodology may be required for a novel implementation.

A logic flow may be implemented in software, firmware, and/or hardware. In software and firmware embodiments, a logic flow may be implemented by computer executable instructions stored on at least one non-transitory computer readable medium or machine readable medium, such as an optical, magnetic or semiconductor storage. The embodiments are not limited in this context.

Figure 4:
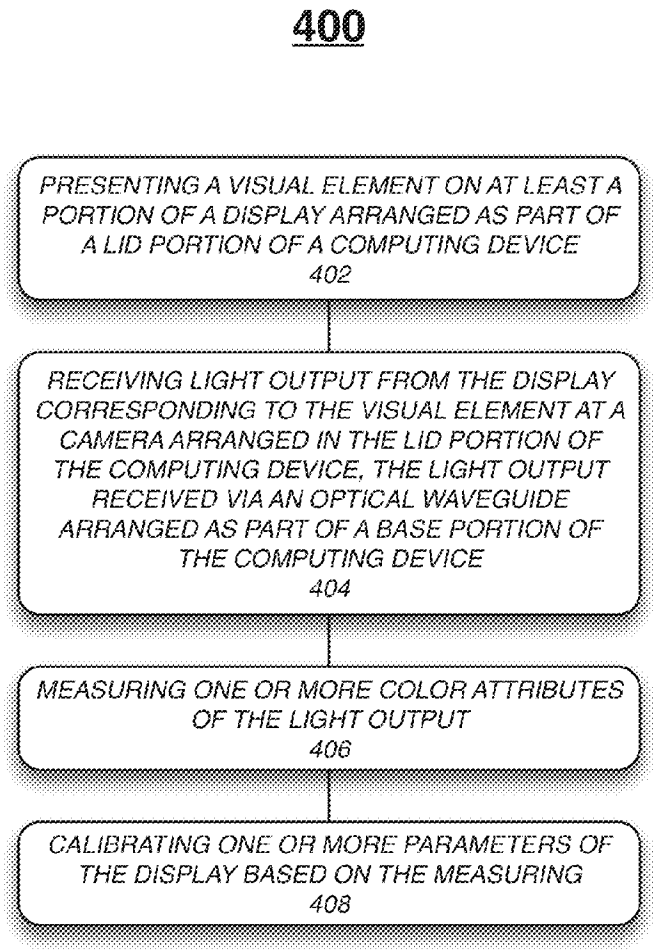
FIG. 4 illustrates an embodiment of a logic flow.

FIG. 4 illustrates an example of a logic flow. As shown in FIG. 4, the logic flow includes a logic flow 400. Logic flow 400 may be representative of some or all of the operations executed by one or more logic, features, systems or devices described herein, such as apparatus 100 and the like. More particularly, logic flow 400 may be implemented by calibration logic 106 of FIG. 1 or any other suitable logic, module, component, device, system or apparatus.

In the illustrated example shown in FIG. 4, logic flow 400 includes presenting a visual element on at least a portion of a display arranged as part of a lid portion of a computing device at 402. For example, calibration logic 106 may be operative to display a visual element on display 110 in an area of entrance portion 210 of optical waveguide 108 in some embodiments. The logic flow 400 may include receiving light output from the display corresponding to the visual element at a camera arranged in the lid portion of the computing device, the light output received via a an optical waveguide arranged as part of a base portion of the computing device at 404. For example, the light output 302 may be transferred or conveyed from the entrance portion 210 to the exit portion 212 by way of the optical waveguide 108 such that the light from display 110 is provided to camera 112.

In various embodiments, the logic flow 400 includes measuring one or more color attributes of the light output at 406 and calibrating one or more parameters of the display based on the measuring at 408. For example, calibration logic 106 may use the light output 302 received by way of optical waveguide 108 to determine one or more parameters of the display 110 to calibrate the display 110. Other embodiments are described and claimed.

Some embodiments of the logic flow 400 include overriding a pre-programmed function associated with closure of the lid portion to maintain operation of the display and/or the camera upon closure of the lid portion. For example, calibration logic 106 may be operative to maintain operation of display 110, camera 112, light source 302, processor 102 and other suitable components upon closure of lid portion 101 to enable the calibration process to be carried out despite the lid portion 101 being closed which may traditionally place the computing system 100 in a sleep or other reduced power or sleep state. Various embodiments of the logic flow 400 include presenting the visual element in an area of the entrance portion of the optical waveguide and dynamically changing the visual element to display a plurality of colors or color combinations. For example, calibration logic 106 may be operative to display or present a visual element on display 110 in an area of entrance portion 210 of optical waveguide 108 such that a plurality of colors or color combinations can be captured by camera 112 to assist with the calibration of claim 110. The embodiments are not limited in this respect.

Figure 5:
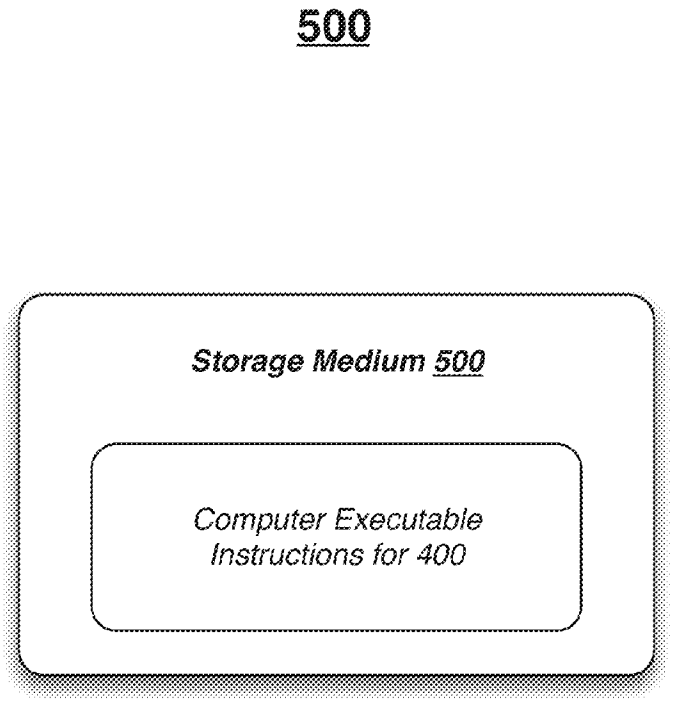
FIG. 5 illustrates an embodiment of a storage medium.

FIG. 5 illustrates an embodiment of a storage medium. As shown in FIG. 5, the storage medium includes a storage medium 500. Storage medium 500 may comprise an article of manufacture. In some examples, storage medium 500 may include any non-transitory computer-readable medium or machine-readable medium, such as an optical, magnetic or semiconductor storage. Storage medium 500 may store various types of computer executable instructions, such as instructions to implement logic flow 400. Examples of a computer readable or machine readable storage medium may include any tangible media capable of storing electronic data, including volatile memory or non-volatile memory, removable or non-removable memory, erasable or non-erasable memory, writeable or re-writeable memory, and so forth. Examples of computer executable instructions may include any suitable type of code, such as source code, compiled code, interpreted code, executable code, static code, dynamic code, object-oriented code, visual code, and the like. The examples are not limited in this context.

Figure 6:
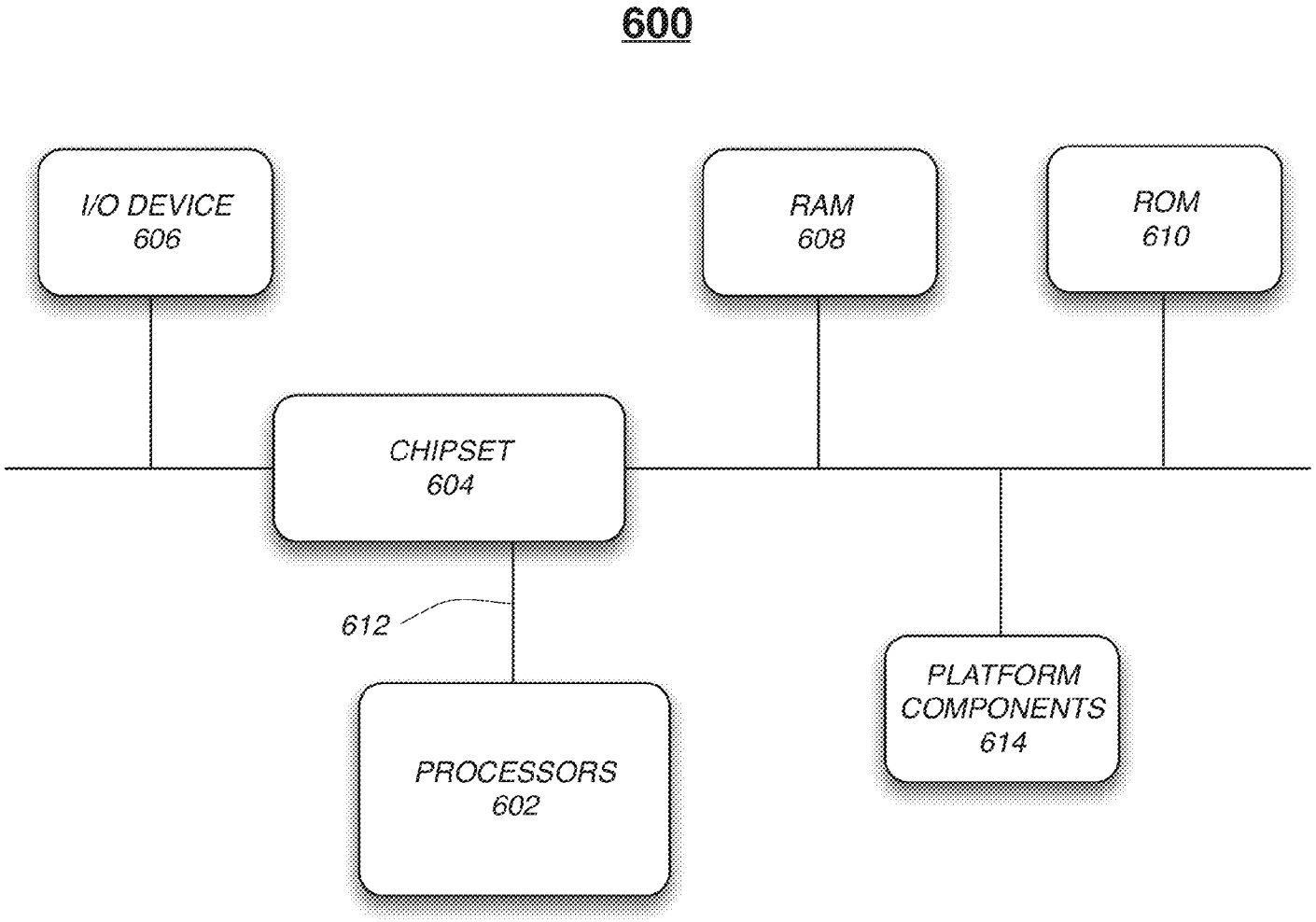
FIG. 6 illustrates one embodiment of a system.

FIG. 6 is a diagram of an exemplary system embodiment. In particular, FIG. 6 is a diagram showing a system 600, which may include various elements. For instance, FIG. 6 shows that system 600 may include a processor 602, a chipset 604, an input/output (I/O) device 606, a random access memory (RAM) (such as dynamic RAM (DRAM)) 608, and a read only memory (ROM) 610, and various platform components 614 (e.g., an optical waveguide, entrance portion 210, exit portion 212, fan, a crossflow blower, a heat sink, DTM system, cooling system, housing, vents, and so forth). These elements may be implemented in hardware, software, firmware, or any combination thereof. The embodiments, however, are not limited to these elements.

In particular, the platform components 614 may include an optical waveguide 108. The optical waveguide 108 may be sized and arranged for the system 600, and may include any arrangement designed to accommodate other components of the system 600 and such that light output from a display of system 600 is provided to a camera of system 600.

As shown in FIG. 6, I/O device 606, RAM 608, and ROM 610 are coupled to processor 602 by way of chipset 604. Chipset 604 may be coupled to processor 602 by a bus 612. Accordingly, bus 612 may include multiple lines.

Processor 602 may be a central processing unit comprising one or more processor cores and may include any number of processors having any number of processor cores. The processor 602 may include any type of processing unit, such as, for example, CPU, multi-processing unit, a reduced instruction set computer (RISC), a processor that have a pipeline, a complex instruction set computer (CISC), digital signal processor (DSP), and so forth.

Although not shown, the system 600 may include various interface circuits, such as an Ethernet interface and/or a Universal Serial Bus (USB) interface, and/or the like. In some exemplary embodiments, the I/O device 606 may comprise one or more input devices connected to interface circuits for entering data and commands into the system 600. For example, the input devices may include a keyboard, mouse, touch screen, track pad, track ball, isopoint, a voice recognition system, and/or the like. Similarly, the I/O device 606 may comprise one or more output devices connected to the interface circuits for outputting information to an operator. For example, the output devices may include one or more displays, printers, speakers, and/or other output devices, if desired. For example, one of the output devices may be a display. The display may be a cathode ray tube (CRTs), liquid crystal displays (LCDs), or any other type of display.

The system 600 may also have a wired or wireless network interface to exchange data with other devices via a connection to a network. The network connection may be any type of network connection, such as an Ethernet connection, digital subscriber line (DSL), telephone line, coaxial cable, etc. The network may be any type of network, such as the Internet, a telephone network, a cable network, a wireless network, a packet-switched network, a circuit-switched network, and/or the like.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Some embodiments may be implemented, for example, using a machine-readable or computer-readable medium or article which may store an instruction, a set of instructions or computer executable code that, if executed by a machine or processor, may cause the machine or processor to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

It should be noted that the methods described herein do not have to be executed in the order described, or in any particular order. Moreover, various activities described with respect to the methods identified herein can be executed in serial or parallel fashion.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. It is to be understood that the above description has been made in an illustrative fashion, and not a restrictive one. Combinations of the above embodiments, and other embodiments not specifically described herein will be apparent to those of skill in the art upon reviewing the above description. Thus, the scope of various embodiments includes any other applications in which the above compositions, structures, and methods are used.

The detailed disclosure now turns to providing examples that pertain to further embodiments. Examples one through twenty-six provided below are intended to be exemplary and non-limiting.

In a first example, an apparatus may comprise an optical waveguide comprising an entrance portion and an exit portion at different locations on a base portion of the apparatus, the optical waveguide to guide light output from a display of the apparatus arranged in a lid portion of the apparatus to a camera arranged in the lid portion of the apparatus and calibration logic at least a portion of which is in hardware, the calibration logic to measure one or more color attributes of the light output from the display and to calibrate one or more parameters of the display based on the measured color attributes.

In a second example of an apparatus, the entrance portion may be arranged to align with a portion of the display when the lid portion is in a closed position and the exit portion arranged to align with the camera when the lid portion is in the closed position.

In a third example of an apparatus, the optical waveguide may be arranged inside the base portion of the apparatus and the entrance portion and exit portion arranged substantially flush with a top surface of the base portion of the apparatus A fourth example of an apparatus may comprise one or more mirrors arranged inside the optical waveguide or external to the optical waveguide.

A fifth example of an apparatus may comprise a light source arranged inside a portion of the optical waveguide, the light source comprising one or more of a red, green or blue light emitting diode (LED).

In a sixth example of an apparatus, the calibration logic may be operative to measure one or more color attributes of light output from the light source and to calibrate one or more parameters of the camera based on the measured color attributes.

A seventh example of an apparatus may comprise a plurality of entrance portions arranged at different locations on a top surface of the base portion of the apparatus.

In an eighth example of an apparatus, the calibration logic may be operative to override a pre-programmed function associated with closure of the lid portion and to maintain operation of the display upon closure of the lid portion.

In a ninth example of an apparatus, the calibration logic may be operative to present a visual element on the display upon closure of the lid portion at least in an area of the entrance portion.

In a tenth example of an apparatus, the visual element may comprise a dynamically changing plurality of colors or color combinations.

In an eleventh example, a computing system may comprise a display arranged as part of a lid portion, a camera arranged as part of the lid portion, and an optical waveguide arranged as part of a base portion, the optical waveguide comprising an entrance portion and an exit portion arranged at different locations on the base portion facing the display when the display is in a closed position, the optical waveguide to guide light output from the display to the camera.

In a twelfth example of a computing system, the lid portion and the base portion may be mechanically coupled to allow rotation of the lid portion.

In a thirteenth example of a computing system, the entrance portion maybe arranged to align with a portion of the display when the lid portion is in the closed position and the exit portion arranged to align with the camera when the lid portion is in the closed position.

In a fourteenth example, a computing system may comprise one or more of one or more mirrors arranged inside the optical waveguide or a light source arranged inside a portion of the optical waveguide, the light source comprising one or more of a red, green or blue light emitting diode (LED).

In a fifteenth example, a computing system may comprise calibration logic at least a portion of which is in hardware, the calibration logic operative to measure one or more color attributes of the light output from the display and to calibrate one or more parameters of the display based on the measured color attributes.

In a sixteenth example of a computing system, the calibration logic may be operative to measure one or more color attributes of light output from a light source arranged inside a portion of the optical waveguide and to calibrate one or more parameters of the camera based on the measured color attributes.

In a seventeenth example of a computing system, the calibration logic may be operative to override a pre-programmed function associated with closure of the lid portion and to maintain operation of the display upon closure of the lid portion and to present a visual element on the display upon closure of the lid portion at least in an area of the entrance portion, the visual element comprising a dynamically changing plurality of colors or color combinations.

In an eighteenth example, an optical waveguide may comprise an entrance portion to be arranged in a base portion of a computing device and to be positioned to be aligned with a portion of a display of the computing device when the display is in a closed position, an exit portion to be arranged in the base portion of the computing device and to be positioned to be aligned with a camera of the computing device when the display is in a closed position, and an internally reflective conduit arranged to couple the entrance portion to the exit portion through the body portion of the computing device.

In a nineteenth example of an optical waveguide, the display and the camera may be arranged in a lid portion of the computing device.

In a twentieth example of an optical waveguide, the internally reflective conduit may be arranged to guide light received at the entrance portion to the exit portion.

In a twenty-first example, an optical waveguide may comprise one or more mirrors arranged inside the internally reflective conduit.

In a twenty-second example of an optical waveguide, the entrance portion and the exit portion may be arranged substantially flush with a top surface of the base portion and substantially parallel to the display when the display is in the closed position.

In a twenty-third example, an article may comprise instructions that if executed enable the system to present a visual element on at least a portion of a display arranged as part of a lid portion of a computing device, receive light output from the display corresponding to the visual element at a camera arranged in the lid portion of the computing device, the light output received via a an optical waveguide arranged as part of a base portion of the computing device, measure one or more color attributes of the light output, and calibrate one or more parameters of the display based on the measuring.

In a twenty-fourth example, an article may comprise instructions that if executed enable the system to override a pre-programmed function associated with closure of the lid portion to maintain operation of the display upon closure of the lid portion.

In a twenty-fifth example, an article may comprise instructions that if executed enable the system to present the visual element in an area of the entrance portion of the optical waveguide.

In a twenty-sixth example, an article may comprise instructions that if executed enable the system to dynamically change the visual element to display a plurality of colors or color combinations.

Other embodiments and examples are described and claimed. In one other example an apparatus may comprise means to perform a method as claimed in any preceding claim or example. In another example machine-readable storage may include machine-readable instructions, when executed, to implement a method or realize an apparatus as claimed in any preceding claim. The embodiments are not limited in this respect.

It is emphasized that the Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter that lies in less than all features of a single disclosed embodiment. Thus the following claims are hereby incorporated into the Detailed Description, with each claim standing on its own as a separate preferred embodiment. In the appended claims, the terms "including" and "in which" are used as the plain-English equivalents of the respective terms "comprising" and "wherein," respectively. Moreover, the terms "first," "second," and "third," etc. are used merely as labels, and are not intended to impose numerical requirements on their objects.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An apparatus, comprising:

an optical waveguide comprising an entrance portion and an exit portion at different locations on a base portion of the apparatus, the optical waveguide to guide light output from a display of the apparatus arranged in a lid portion of the apparatus to a camera arranged in the lid portion of the apparatus;

a light source arranged inside a portion of the optical waveguide, the light source comprising one or more of a red, green or blue light emitting diode (LED); and calibration logic at least a portion of which is in hardware, the calibration logic to:

measure one or more color attributes of the light output from the display as captured by the camera and to calibrate one or more parameters for the display based on the measured one or more color attributes; and measure one or more color attributes of light output from the light source and to calibrate one or more parameters for the camera based on the measured color attributes.

2. The apparatus of claim 1, the entrance portion arranged to align with a portion of the display when the lid portion is in a closed position and the exit portion arranged to align with the camera when the lid portion is in the closed position.

3. The apparatus of claim 1, the optical waveguide arranged inside the base portion of the apparatus and the entrance portion and exit portion arranged substantially flush with a top surface of the base portion of the apparatus.

4. The apparatus of claim 1, comprising:

one or more mirrors arranged inside the optical waveguide.

5. The apparatus of claim 1, comprising:

a plurality of entrance portions arranged at different locations on a top surface of the base portion of the apparatus.

6. The apparatus of claim 1, the calibration logic to override a pre-programmed function associated with closure of the lid portion and to maintain operation of the display upon closure of the lid portion.

7. The apparatus of claim 1, the calibration logic to present a visual element on the display upon closure of the lid portion at least in an area corresponding to the entrance portion.

8. The apparatus of claim 7, the visual element comprising a dynamically changing plurality of colors or color combinations.

9. A computing system, comprising:

a display arranged as part of a lid portion;

a camera arranged as part of the lid portion;

an optical waveguide arranged as part of a base portion, the optical waveguide comprising an entrance portion and an exit portion arranged at different locations on the base portion facing the lid portion when the lid portion is in a closed position, the optical waveguide to guide light output from the display to the camera; and calibration logic at least a portion of which is in hardware, the calibration logic to:

measure one or more color attributes of the light output from the display and to calibrate one or more parameters of the display based on the measured color attributes; and measure one or more color attributes of light output from a light source arranged inside a portion of the optical waveguide and to calibrate one or more parameters of the camera based on the measured color attributes.

10. The computing system of claim 9, the lid portion and the base portion mechanically coupled to allow rotation of the lid portion.

11. The computing system of claim 9, the entrance portion arranged to align with a portion of the display when the lid portion is in the closed position and the exit portion arranged to align with the camera when the lid portion is in the closed position.

12. The computing system of claim 9, comprising one or more of:

one or more mirrors arranged inside the optical waveguide; or a light source arranged inside a portion of the optical waveguide, the light source comprising one or more of a red, green or blue light emitting diode (LED).

13. The computing system of claim 9, the calibration logic to override a pre-programmed function associated with closure of the lid portion and to maintain operation of the display upon closure of the lid portion and to present a visual element on the display upon closure of the lid portion at least in an area of the entrance portion, the visual element comprising a dynamically changing plurality of colors or color combinations.

14. An optical waveguide, comprising:

an entrance portion to be arranged in a base portion of a computing device and to be positioned to be aligned with a portion of a display of the computing device when the display is in a closed position;

an exit portion to be arranged in the base portion of the computing device and to be positioned to be aligned with a camera of the computing device when the display is in a closed position;

a corner portion to be arranged in the base portion of the computing device and to be positioned to be aligned with a light source of the computing device;

An internal light source arranged inside a portion of the optical waveguide, the light source comprising one or more of a red, green or blue light emitting diode (LED); and an internally reflective conduit arranged to couple the entrance portion and the internal light source to the exit portion and to be arranged through the base portion of the computing device.

15. The optical waveguide of claim 14, the display and the camera arranged in a lid portion of the computing device.

16. The optical waveguide of claim 14, the internally reflective conduit to guide light received at the entrance portion to the exit portion.

17. The optical waveguide of claim 14, comprising one or more mirrors arranged inside the internally reflective conduit.

18. The optical waveguide of claim 14, the entrance portion and the exit portion arranged substantially flush with a top surface of the base portion and have a portion substantially parallel to the display when the display is in the closed position.

19. An article comprising a storage medium containing instructions that if executed enable a system to:

receive first light output from a light source, the first light output received via an optical waveguide arranged as part of a base portion of a computing device;

measure one or more color attributes of the first light output;

calibrate one or more parameters of a camera arranged as part of a lid portion of the computing device based on the measured color attributes of the first light output;

present a visual element on at least a portion of a display arranged as part of the lid portion of the computing device;

receive second light output from the display corresponding to the visual element at the camera arranged in the lid portion of the computing device, the second light output received via the optical waveguide;

measure one or more color attributes of the second light output; and calibrate one or more parameters of the display based on the measured color attributes of the second light output.

20. The article of claim 19, comprising instructions that if executed enable the system to:

override a pre-programmed function associated with closure of the lid portion to maintain operation of the display upon closure of the lid portion.

21. The article of claim 19, comprising instructions that if executed enable the system to:

present the visual element in an area of an entrance portion of the optical waveguide.

22. The article of claim 19, comprising instructions that if executed enable the system to:

dynamically change the visual element to display a plurality of colors or color combinations.

* * * * *